United States Patent [19]

Miyake et al.

[11] 4,434,410

[45] Feb. 28, 1984

[54] COAXIAL RESONATOR

[75] Inventors: Hideyuki Miyake, Matsubara; Tosiaki Nakamura, Kyoto, both of Japan

[73] Assignee: Matsushita Electric Industrial Co., Ltd., Kadoma, Japan

[21] Appl. No.: 399,135

[22] Filed: Jul. 16, 1982

[30] Foreign Application Priority Data

Jul. 23, 1981 [JP] Japan ..... 56-115742

[51] Int. Cl.[3] ..... H01P 7/04; H01P 1/202

[52] U.S. Cl. ..... 333/224; 333/207; 333/235

[58] Field of Search ..... 333/202, 206, 207, 222, 333/223, 224, 225, 226, 227, 232, 235, 245; 331/101, 102; 334/41, 45

[56] References Cited

U.S. PATENT DOCUMENTS

| | | | |
|---|---|---|---|
| 2,085,223 | 6/1937 | Kolster | 333/45 |
| 2,097,519 | 11/1937 | Gabriel et al. | 333/224 X |
| 4,276,525 | 6/1981 | Nishikawa et al. | 333/206 |
| 4,342,972 | 8/1982 | Nishikawa et al. | 333/206 |

*Primary Examiner*—Marvin L. Nussbaum

*Attorney, Agent, or Firm*—Wenderoth, Lind & Ponack

[57] ABSTRACT

The disclosure is directed to an improved coaxial resonator such as a λ/4 coaxial resonator or the like to be used for an electrical filter or oscillator, etc. which operates, for example, in UHF ranges. The coaxial resonator includes a stator electrode provided on the resonator main body, a rotor of a dielectric material formed with a rotor electrode confronting the stator electrode and rotatably mounted on the resonator main body so as to vary capacity between the stator electrode and the rotor electrode through rotation of the rotor for alterations of the resonance frequency.

5 Claims, 14 Drawing Figures

COAXIAL RESONATOR

BACKGROUND OF THE INVENTION

The present invention generally relates to an electrical resonator and more particularly, to a coaxial resonator for use in an electrical filter or oscillator to be applied, for example, to UHF ranges.

With respect to coaxial resonators to be used for electrical and electronic equipment which operate, for example, in UHF ranges, it has been a recent trend that a ¼ wavelength coaxial resonator (referred to as a λ/4 coaxial resonator hereinbelow) compact in size and composed of a dielectric member having a high unloaded Q begins to be adopted. However, by the coaxial resonator as described above alone, its resonance frequency can not be readily altered, thus requiring much time for the adjustments thereof. Accordingly, it is so arranged in some cases, that a trimmer capacitor or the like is added to the coaxial resonator for making it possible to readily alter the resonance frequency, but in this case, there have been such disadvantages that the size of the coaxial resonator tends to be increased, while the high unloaded Q which is an essential feature of the λ/4 coaxial resonator employing the dielectric member is undesirably lowered.

In FIG. 1, there is shown one example of the conventional arrangements as referred to above, in which a coaxial resonator 2 constituted by the cylindrical dielectric member, and having electrode layers formed on inner and outer peripheral surfaces and also on one end face of the dielectric member by a metallizing process or the like, is mounted on a printed circuit board 1, while a trimmer capacitor 3 is disposed in the vicinity of the coaxial resonator 2, with a ground terminal 4 of the trimmer capacitor 3 being connected to the electrode formed on the inner peripheral surface of the coaxial resonator 2.

The known arrangement as described above, however, still has drawbacks in that, since the ground terminal 4 of the trimmer capacitor 3 is prolonged to be connected to the electrode on the inner peripheral surface of the coaxial resonator 2, an electrical loss tends to be produced depending on the length of the ground terminal 4, thus resulting in deterioration of unloaded Q, while addition of the completely independent trimmer capacitor 2 and also necessity for employing the printed circuit board 1 give rise to increase of the number of parts involved, with consequent rise in cost and economical disadvantage.

SUMMARY OF THE INVENTION

Accordingly, an essential object of the present invention is to provide an improved coaxial resonator, for example, a λ/4 coaxial resonator which is arranged to suppress deterioration of unloaded Q to the minimum and capable of efficiently varying the resonance frequency thereof.

Another important object of the present invention is to provide an improved coaxial resonator of the above described type in which a mechanism for varying the resonance frequency thereof is integrally formed therewith for compact size of the resonator on the whole.

A further object of the present invention is to provide a compact electrical filter, oscillator, or the like with high performance and reliability at low cost, through employment of the improved coaxial resonator of the above described type.

In accomplishing these and other objects, according to one preferred embodiment of the present invention, there is provided a coaxial resonator which includes a coaxial resonator main body constituted by a cylindrical dielectric member, an electrode layer continuously formed over an inner peripheral surface, an outer peripheral surface and one end face of the dielectric member, and a stator electrode formed on the other end face of the dielectric member not formed with said electrode layer, and a rotor member of a dielectric material rotatably held in close contact with the other end face of said coaxial resonator main body on which the stator electrode is formed, and provided with a rotor electrode confronting the stator electrode. The coaxial resonator is arranged to vary capacity between the stator electrode and the rotor electrode by rotating the rotor member.

By the arrangement of the present invention as described above, an improved coaxial resonator capable of varying resonance frequency is advantageously presented, with a minimum deterioration of the unloaded Q.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
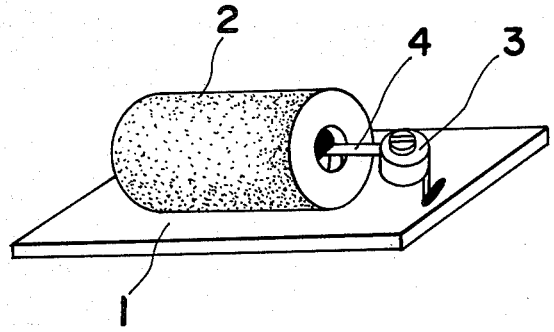
Fig. 1 PRIOR ART
FIG. 1 is a schematic perspective view of a coaxial resonator having a conventional resonance frequency varying arrangement (already referred to)
Figure 2:
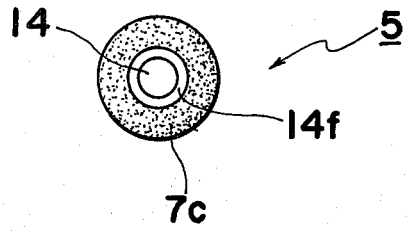
FIG. 2 is a rear side view (i.e. bottom plan view in FIG. 5) of a coaxial resonator according to one preferred embodiment of the present invention.
Figure 3:
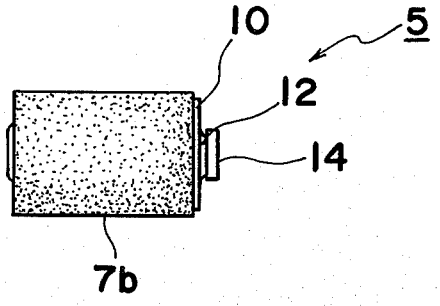
FIG. 3 is a side elevational view of the coaxial resonator of FIG. 2.
Figure 4:
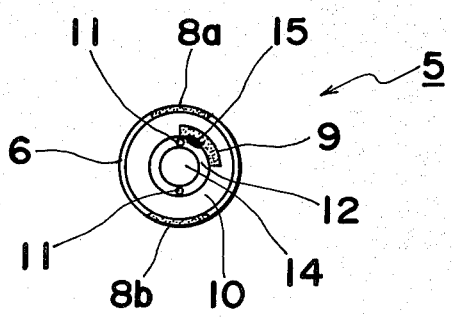
FIG. 4 is a front side view (i.e. top plan view in FIG. 5) of the coaxial resonator of FIG. 2.
Figure 5:
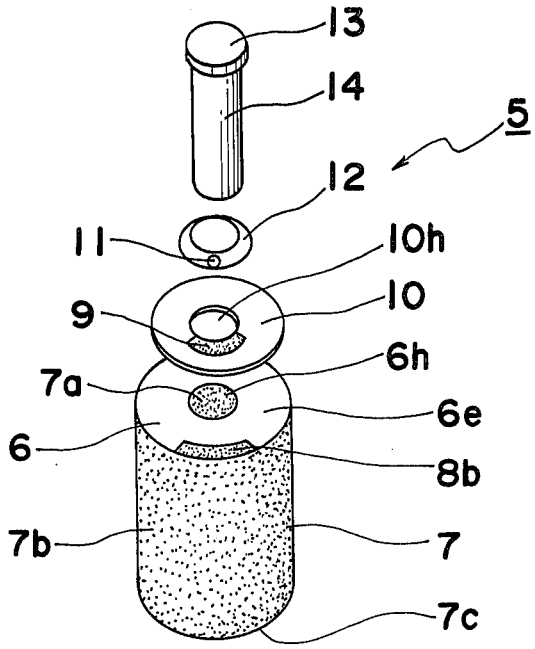
FIG. 5 is a perspective exploded view of the coaxial resonator of FIG. 2.
Figure 6:
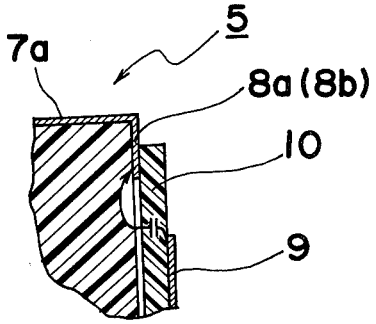
FIG. 6 is a fragmentary side sectional view showing, on an enlarged scale, a main portion of the coaxial resonator of FIG. 2.

Before the description of the present invention proceeds, it is to be noted that like parts are designated by like reference numerals throughout the accompanying drawings.

Referring now to the drawings, there is shown, in FIGS. 2 through 8, a ¼ wavelength or λ/4 coaxial resonator 5 according to one preferred embodiment of the present invention. The coaxial resonator 5 generally includes a cylindrical dielectric member 6 (FIG. 5) composed, for example, of a ceramic material or the like as a resonator main body, and formed with a central axial bore 6*h* extending therethrough, an electrode layer 7 including an inner electrode or conductor 7*a* formed on an inner peripheral surface of the axial bore 6*h* of the dielectric member 6, an outer electrode or conductor 7*b* formed on an outer peripheral surface of the dielectric member 6, and an end face electrode or conductor 7*c* formed on one end face of the dielectric member 6, all of which electrodes are continuously applied onto said dielectric member 6 by a metallizing process and the like, a pair of opposed stator electrode layers 8*a* and 8*b* (FIG. 4) formed along an outer peripheral edge of the other end face 6*e* of the dielectric member 6 not formed with the electrode layer 7 so as to be electrically conducted with the electrode layer 7, an annular rotor 10 of a dielectric material provided with a sector-shaped rotor electrode 9 formed on its one surface along a peripheral edge of a central opening 10*h* thereof so as to correspond to the stator electrodes 8*a* and 8*b* of the dielectric member 6, and disposed in close contact with the end face 6*e* of the dielectric member 6, and a shaft 14 with a head portion 13, inserted into the inner electrode 7*a* formed in the axial bore 6*h* of the dielectric member 6 through a spring member 12 having a pair of holes 11 to receive an adjusting tool 16 (FIG. 8) for capacity adjustment, and also through the central opening 10*h* of the rotor 10, with the distal end of the shaft 14 extended through the dielectric member 6 being electrically and mechanically connected to the electrode 7*c*, for example, by staking as at 14*f* (FIG. 2) or by soldering or the like, while the spring member 12 and the rotor electrode 9 of the rotor 10 are connected to each other by solder 15 (FIG. 4) and the like.

It should be noted here that the configuration of the dielectric member 6 is not limited to the cylindrical shape as described in the foregoing embodiment, but may be modified into various other shapes, for example, into a square tube-like configuration, etc.

Figure 7:
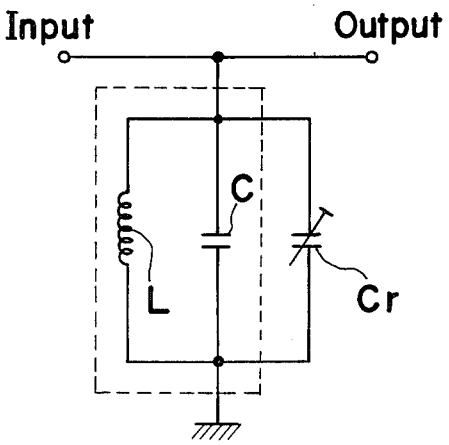
FIG. 7 is an electrical circuit diagram showing an equivalent circuit for the coaxial resonator of FIG. 2.

Referring also to FIG. 7 showing an equivalent circuit for the coaxial resonator of the present invention, the coaxial resonator 5 as described so far may be represented by the equivalent circuit surrounded by dotted lines in FIG. 7, in which a capacity C formed between the outer peripheral surface and inner peripheral surface of the dielectric member 6 for the electrode 7, and inductance L of the electrode layer 7 are coupled in parallel relation with each other. Meanwhile, a variable capacity $C_T$ obtained by the stator electrodes 8*a* and 8*b* of the coaxial resonator 5 and the rotor electrode 9 of the rotor 10 forms a circuit to be connected in parallel with the above parallel circuit, thus a resonance circuit capable of varying the resonance frequency is constituted.

Figure 8:
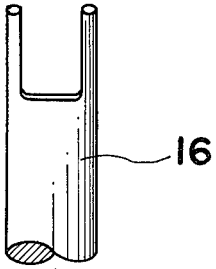
FIG. 8 is a fragmentary side elevational view of an adjusting tool which may be employed for the adjustment of the coaxial resonator of FIG. 2.
Figure 9:
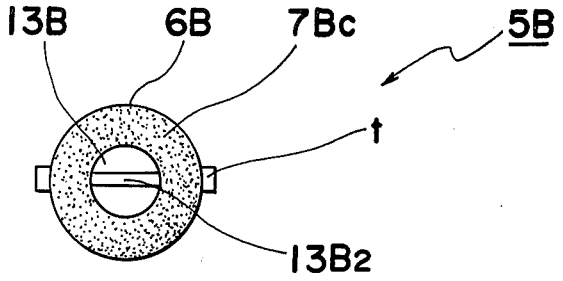
FIG. 9 is a rear side view (i.e. bottom plan view in FIG. 12) of a coaxial resonator according to another embodiment of the present invention.
Figure 10:
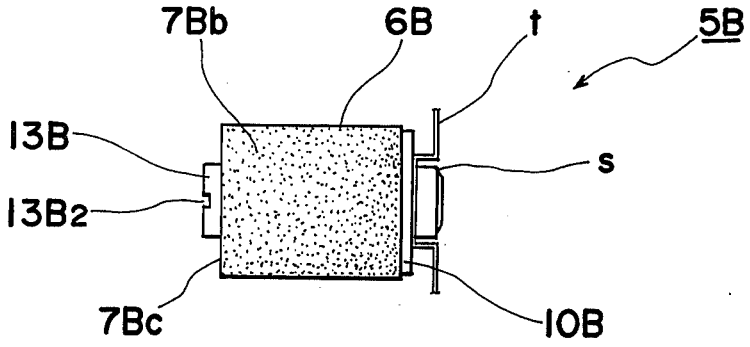
FIG. 10 is a side elevational view of the coaxial resonator of FIG. 9.
Figure 11:
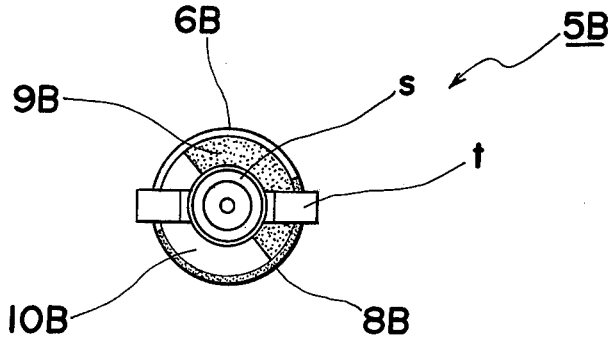
FIG. 11 is a front side view (i.e. top plan view in FIG. 12) of the coaxial resonator of FIG. 9.
Figure 12:
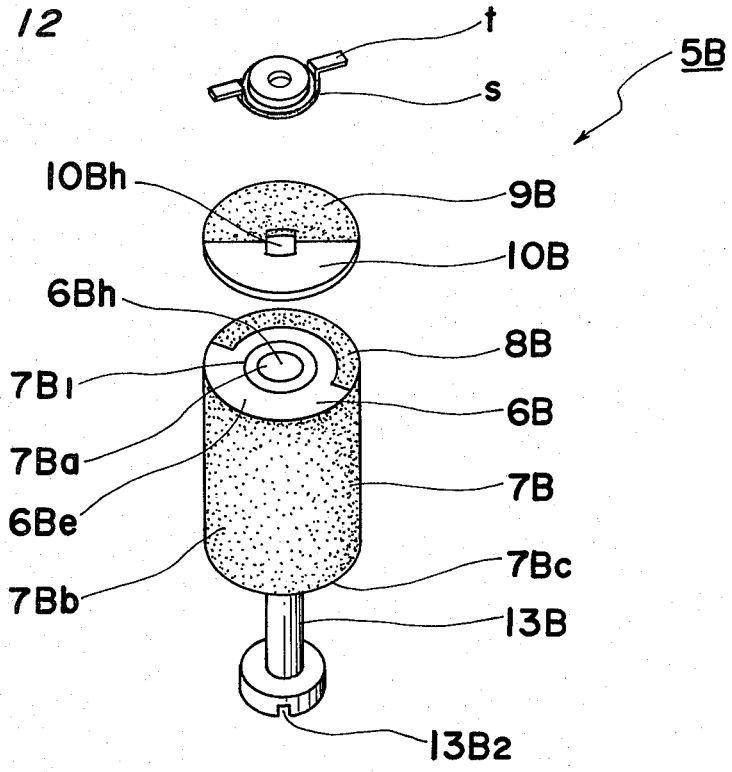
FIG. 12 is a perspective exploded view of the coaxial resonator of FIG. 9.
Figure 13:
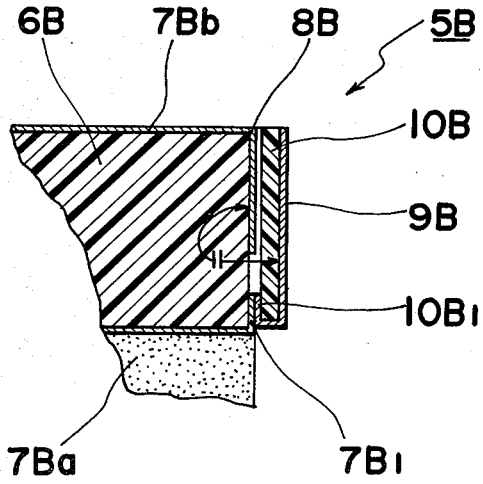
FIG. 13 is a fragmentary side sectional view showing, on an enlarged scale, a main portion of the coaxial resonator of FIG. 9.
Figure 14:
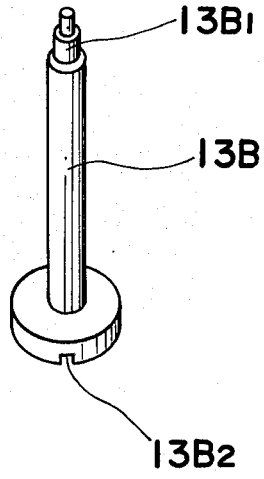
FIG. 14 is a perspective view of a central shaft employed in the coaxial resonator of FIG. 9.

By the above arrangement, when the rotor 10 is rotated together with the spring member 12, with the ends of the adjusting tool 16 as shown in FIG. 8 fitted into the corresponding holes 11 of the spring member 12, confronting areas between the rotor electrode 9 of the rotor 10 and the stator electrode 8*a* or 8*b* of the coaxial resonator 5 are varied so as to alter the capacity at an open side of the resonator 5, thus making it possible to vary the resonance frequency.

It should be noted here that, the arrangement of the embodiment described so far may be further modified, for example, in such a manner that, with the spring member 12 omitted, by forming the adjusting tool receiving holes 11 directly in the rotor 10, the rotor 10 is held in pressure contact with the end face 6*e* of the dielectric coaxial resonator 5 through the head portion 13 of the shaft 14.

Referring further to FIGS. 9 through 14, there is shown a coaxial resonator 5B according to another embodiment of the present invention. The coaxial resonator 5B also includes the cylindrical dielectric member 6B composed, for example, of a ceramic material or the like as a resonator main body, and formed with the central axial bore 6B*h* extending therethrough, the electrode layer 7B including the inner electrode or conductor 7B*a* formed on the inner peripheral surface of the axial bore 6B*h* of the dielectric members 6B, the outer electrode or conductor 7B*b* formed on the outer peripheral surface of the dielectric member 6B, and the end face electrode or conductor 7B*c* formed on one end face of the dielectric member 6B, all of which are continuously applied onto said dielectric member 6B by a metallizing process and the like generally in the similar manner as in the embodiment of FIGS. 2 through 8 so far.

On the end surface 6B*e* of the coaxial resonator 5B not formed with the electrode 7B*c*, an annular internal electrode 7B1 concentrically formed around the peripheral edge of the axial bore 6B*h* and connected to the inner electrode 7B*a* of the electrode 7B, and a sector-shaped stator electrode 8B formed around the outer peripheral edge of the dielectric member 6B and connected to the outer electrode layer 7B*b* of the electrode 7B are respectively provided. Meanwhile, a rotor 10B formed, on its one surface, with a semi-circular rotor electrode 9B to confront the stator electrode 8B, and on its other surface, with a contact electrode 10B1 (FIG. 13) conducted with said rotor electrode 9B via a through-hole or the like, is disposed on the end surface 6B*e* formed with the internal electrode 7B1 and the stator electrode 8B, in close contact with said end surface 6B*e*, with a central square hole 10B*h* of the rotor 10B being engaged with an engaging portion 13B1 having a corresponding square cross section and formed at the end (i.e. upper end in FIG. 14) of a shaft 13B to be inserted into the axial bore 6B*h* of the coaxial resonator 5B through the end face 7B*c* of said resonator 5B. In the head portion at the other end (i.e. lower end in FIG. 14) of the shaft 13B, a groove 13B2 is formed for receiving therein an end of an adjusting tool or screw driver and the like (not particularly shown) for capacity adjustment. Moreover, to the distal end of the shaft 13B above the engaging portion 13B1 thereof, a spring member S having a pair of terminal lugs t extending outwardly therefrom is fixed, for example, by staking or threading engagement, and thus, the rotor 10B is held in close contact with the end face 6B*e* of the coaxial resonator 5B through proper resiliency, with the contact electrode 10B1 (FIG. 13) of the rotor 10B electrically contacting the annular internal electrode 7B1 of the resonator 5B. The spring member S is electrically connected with the rotor electrode 9B of the rotor 10B through the terminal lugs t thereof.

The coaxial resonator 5B described so far with reference to FIGS. 9 through 14 may also be represented by the equivalent circuit as shown in FIG. 7, in the similar manner as in the embodiment of FIGS. 2 to 8, and upon rotation of the rotor 10B through the shaft 13B, the capacity at the open side of the coaxial resonator 5B may be varied, thereby to change the resonance frequency thereof as desired.

As is clear from the foregoing description, according to the coaxial resonator of the present invention, only parts required for functioning as a trimmer capacitor are the resonator main body, rotor and shaft, and thus, the coaxial resonator capable of varying resonance frequency may be constituted by the extremely small number of parts involved, with a consequent simplification of assembly and reduction in cost, while, owing to the arrangement in which the stator electrode is continued to the electrode of the coaxial resonator main body, not only loss is very small as an coaxial resonator dealing with high frequencies, but alterations of resonance frequency may be positively effected in a simple manner, with substantial elimination of disadvantages inherent in the conventional coaxial resonators of this kind.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A coaxial resonator which comprises:

a coaxial resonator main body including a cylindrical dielectric member, an electrode layer continuously formed over an inner peripheral surface, an outer peripheral surface and one end face of said dielectric member, and a stator electrode formed on the other end face of said dielectric member not formed with said electrode layer, and a rotor member of a dielectric material rotatably held in close contact with said the other end face of said coaxial resonator main body on which said stator electrode is formed, and provided with a rotor electrode confronting said stator electrode, said coaxial resonator being arranged to vary capacity between said stator electrode and said rotor electrode by rotating said rotor member.

2. A coaxial resonator as claimed in claim 1, wherein said rotor member is rotatably mounted on the coaxial resonator main body through a shaft member extending through said coaxial resonator main body and said rotor member.

3. A coaxial resonator as claimed in claim 1 or 2, wherein said rotor member is held in pressure contact with said coaxial resonator main body through a spring member.

4. A coaxial resonator as claimed in claim 2, wherein said shaft member is coupled with said rotor member, and is formed with a groove means for receiving therein an adjusting tool for adjustment of the capacity.

5. A coaxial resonator as claimed in claim 1, wherein said the other end face of said coaxial resonator main body is further provided with an internal electrode connecting to said electrode layer formed in said inner peripheral surface of said coaxial resonator main body, said rotor member being provided with a contact electrode connected to said rotor electrode for electrical contact between said internal electrode of said coaxial resonator main body and said contact electrode of said rotor member.

* * * * *